US008385759B2

(12) United States Patent
Saka et al.

(10) Patent No.: US 8,385,759 B2
(45) Date of Patent: Feb. 26, 2013

(54) IMAGE FORMING APPARATUS AND IMAGE FORMING METHOD

(75) Inventors: Yoshihisa Saka, Nagano (JP); Yujiro Nomura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 249 days.

(21) Appl. No.: 12/848,384

(22) Filed: Aug. 2, 2010

(65) Prior Publication Data

US 2011/0058830 A1 Mar. 10, 2011

(30) Foreign Application Priority Data

Sep. 7, 2009 (JP) ..... 2009-205826

(51) Int. Cl.
*G03G 15/00* (2006.01)
*G03G 15/16* (2006.01)

(52) U.S. Cl. ..... 399/45; 399/66

(58) Field of Classification Search ..... 399/66, 399/303, 304, 389, 45
See application file for complete search history.

(56) References Cited

U.S. PATENT DOCUMENTS 6,163,676 A 12/2000 Levanon et al.
2009/0142083 A1* 6/2009 Minbu ..... 399/45

FOREIGN PATENT DOCUMENTS

JP 2000-508280 A 7/2000
JP 2000238400 A * 9/2000
JP 2008-122815 A 5/2008
WO WO-97/09262 A 3/1997

OTHER PUBLICATIONS

Machine translation of JP 2000238400 A obtained on May 31, 2012.*

* cited by examiner

*Primary Examiner* — David Gray
*Assistant Examiner* — Gregory H Curran
(74) *Attorney, Agent, or Firm* — Global IP Counselors, LLP

(57) ABSTRACT

An image forming apparatus including: an image bearing belt that bears an image; an image creation unit that transfers the image on the image bearing belt; a first driving source; a driving roller that is rotationally driven by the first driving source and causes the image bearing belt to move; a transfer roller that has a concaved portion in a circumferential surface, forms a transfer nip by the transfer roller making contact with the image bearing belt, and transfers the image on the image bearing belt to a recording material; a second driving source that rotationally drives the transfer roller; a material type determination unit that determines a type of the recording material; and a control unit that controls a rotational frequency of the transfer roller when the recording material is nipped by the transfer nip based on information of the type determined by the material type determination unit.

5 Claims, 7 Drawing Sheets

START OF TRANSPORT OF RECORDING PAPER

START OF PAPER GRIPPING OPERATION

END OF PAPER GRIPPING OPERATION

START OF SECONDARY TRANSFER PROCESS

DURING SECONDARY TRANSFER PROCESS

RELEASE OF RECORDING PAPER

FIG. 7

| SECONDARY TRANSFER LOAD (kgf) | PAPER BASIS WEIGHT ($g/m^2$) | PAPER THICKNESS (mm) | ROTATIONAL FREQUENCY OF SECONDARY TRANSFER ROLLER | |
|---|---|---|---|---|
| | | | V1 (rpm) | V2 (rpm) |
| 60 | 127 | 0.15 | 24.63 | 24.51 |
| | 256 | 0.25 | 24.63 | 24.50 |
| | 310 | 0.30 | 24.63 | 24.48 |

IMAGE FORMING APPARATUS AND IMAGE FORMING METHOD

BACKGROUND

1. Technical Field

The present invention relates to an image forming apparatus that includes an image bearing belt that bears an image and a transfer roller that forms a transfer nip by making contact with the image bearing belt and that has a concaved portion in one part of its circumferential surface, and an image forming method for such an image forming apparatus.

2. Related Art

There are, in the field of image forming techniques for forming images upon recording material such as paper, apparatuses configured to transfer an image that has first been formed on an image bearing belt onto the recording material. For example, with an image forming apparatus disclosed in JP-A-2008-122815 (see FIG. 1 of JP-A-2008-122815), an image forming station forms an image upon a transfer belt, serving as an image bearing member, that is stretched upon multiple rollers, and the image is transferred from the transfer belt onto recording material by causing the recording material to pass through a transfer nip formed by the transfer belt and a secondary transfer roller making contact with each other.

In order to carry out the image transfer from the image bearing member to the recording material at a high transfer efficiency, it is desirable to apply a high amount of pressure to the recording material as it passes through the transfer nip. On the other hand, there is a risk that the recording material will stick to the image bearing member if a high amount of pressure is applied in such a manner. For example, the image forming apparatus disclosed in JP-A-2008-122815 employs what is known as a liquid developing technique, visualizing an electrostatic latent image using a developer that has been dispersed throughout a liquid carrier, and thus sticking of the recording material due to the residual liquid carrier occurs with ease.

Accordingly, employing a technique such as that disclosed in, for example, JP-T-2000-508280 (see FIG. 2A of JP-T-2000-508280), can be considered as a way to solve such a problem. With an image apparatus disclosed in JP-T-2000-508280, a gripper, serving as a gripping member, that can freely open and close is provided in one part of the circumferential surface of a cylindrical pressure roller (this corresponds to a transfer roller); recording material is prevented from sticking to an intermediate transfer member that makes contact with the pressure roller by the gripper gripping an end of the recording material. Note that the intermediate transfer member, which serves as an image bearing member in JP-T-2000-508280, is a roller-shaped rotating member.

There are cases where the following problem occurs when the aforementioned JP-A-2008-122815 and JP-T-2000-508280 are taken in combination with each other. With an apparatus having such a combination, a transfer belt that bears an image and a pressure roller are each driven at respective constant speeds; a transfer nip is formed by the pressure roller pressing against the transfer belt, and the image is transferred onto recording material by causing the recording material to pass through the transfer nip. Here, in order to increase the quality of the image transferred onto the recording material, it is desirable to match the speed of movement of the recording material that passes through the nip to the speed of movement of the transfer belt. This is actually because a difference in the speeds of movement causes the occurrence of abrasions in the image. This is also because the burden on the driving source of the transfer belt is increased due to a difference in the speeds of movement as described above; this leads to disturbances in the speed of movement of the transfer belt, which in turn makes it impossible to carry out the primary transfer of the image onto the transfer belt in a favorable manner.

However, there are various types of recording material, and there are cases where the speed of movement of the transfer belt and the speed of movement of the recording material are skewed from each other depending on the type of the recording material that passes through the transfer nip. The amount of skew between the speeds of movement is particularly severe in the case where the thicknesses of recording materials differ. For example, if a case where a comparatively light recording material (for example, a basis weight of 127 ($g/m^2$)) passes through the transfer nip is compared to a case where a comparatively heavy recording material (for example, a basis weight of 310 ($g/m^2$)) passes through the transfer nip, the speed of movement at the transfer nip is higher for the heavy material than for the light paper. Accordingly, with the aforementioned apparatus, it has been difficult to form an image in a favorable image quality onto recording papers of various types, and the apparatus has thus been problematic in terms of its general applicability.

SUMMARY

An advantage of some aspects of the invention is to provide a technique that solves the aforementioned problems arising when forming an image onto recording paper by causing the recording paper to pass through a transfer nip formed by a transfer roller having a concaved portion in one part of its circumferential surface making contact with an image bearing belt, and is thus capable of forming an image onto recording papers of various types in a favorable manner.

An image forming apparatus according to one aspect of the invention includes: an image bearing belt that bears an image; an image creation unit that forms the image on the image bearing belt; a first driving source; a driving roller, upon which the image bearing belt is wound, that is rotationally driven by the first driving source and causes the image bearing belt to move; a transfer roller that has a concaved portion in one part of its circumferential surface, forms a transfer nip by the circumferential surface of the transfer roller making contact with the image bearing belt, and transfers the image borne by the image bearing belt onto a recording paper that passes through the transfer nip; a second driving source that rotationally drives the transfer roller; a material type determination unit that determines the material type of the recording paper that passes through the transfer nip; and a control unit that controls the speed of movement of the image bearing belt to be constant or approximately constant and controls the rotational frequency of the transfer roller when the recording paper is nipped by the transfer nip based on information of the material type determined by the paper type determination unit.

Meanwhile, an image forming method according to an aspect of the invention includes: forming an image upon an image bearing belt that is moved by a first driving source; transporting a recording paper to a transfer nip formed by the circumferential surface of a transfer roller, which includes a concaved portion in one part of its circumferential surface, making contact with the image bearing belt while rotationally driving the transfer roller using a second driving source; and adjusting the rotational frequency of the transfer roller based on information of the paper type of the recording material while controlling the speed of movement of the image bearing belt to be constant or approximately constant when the transported recording paper has been nipped by the transfer nip.

In the aspects of the invention (the image forming apparatus and the image forming method) configured in this manner, a transfer nip is formed by the circumferential surface of the transfer roller making contact with the image bearing belt, and the image formed on the image bearing belt is transferred onto the recording paper by the recording paper passing through the transfer nip. Because the recording paper follows the rotational frequency of the transfer roller when the recording paper passes through the transfer nip, it is possible to control the speed of movement of the recording paper in accordance with the rotational frequency of the transfer roller. Accordingly, in the invention, the rotational frequency of the transfer roller is controlled based on information of the paper type of the recording material when the recording paper is nipped in the transfer nip, thus suppress a speed difference between the speed of movement of the recording paper and the speed of movement of the transfer belt. As a result, abrasions can be suppressed from occurring in the image at the transfer nip, and speed fluctuations in the image bearing belt can be suppressed, thus making it possible to form a favorable image upon the recording paper.

The configuration may be such that the rotational frequency of the transfer roller is adjusted by the control unit controlling the second driving source.

Meanwhile, in the case where paper thicknesses of recording papers differ from each other, the amount of skew in the speeds of movement between the recording paper and the image bearing belt fluctuates greatly in accordance with paper thickness differences, it is particularly desirable to take into consideration the paper thickness of the recording paper as the paper type. In addition, because the speed of movement at the transfer nip is higher for heavy paper than for light paper, it is favorable for the control unit to control the transfer roller to assume a first rotational frequency when the paper thickness of the recording paper is a first thickness, and for the control unit to control the transfer roller to assume a second rotational frequency that is lower than the first rotational frequency when the paper thickness of the recording paper is a second thickness that is thicker than the first thickness.

BRIEF DESCRIPTION OF THE DRAWINGS

The invention will be described with reference to the accompanying drawings, wherein like numbers reference like elements.

FIG. 7 is a diagram illustrating a relationship between a paper type of recording material and a rotational frequency of a secondary transfer roller.

DESCRIPTION OF EXEMPLARY EMBODIMENTS

Figure 1:
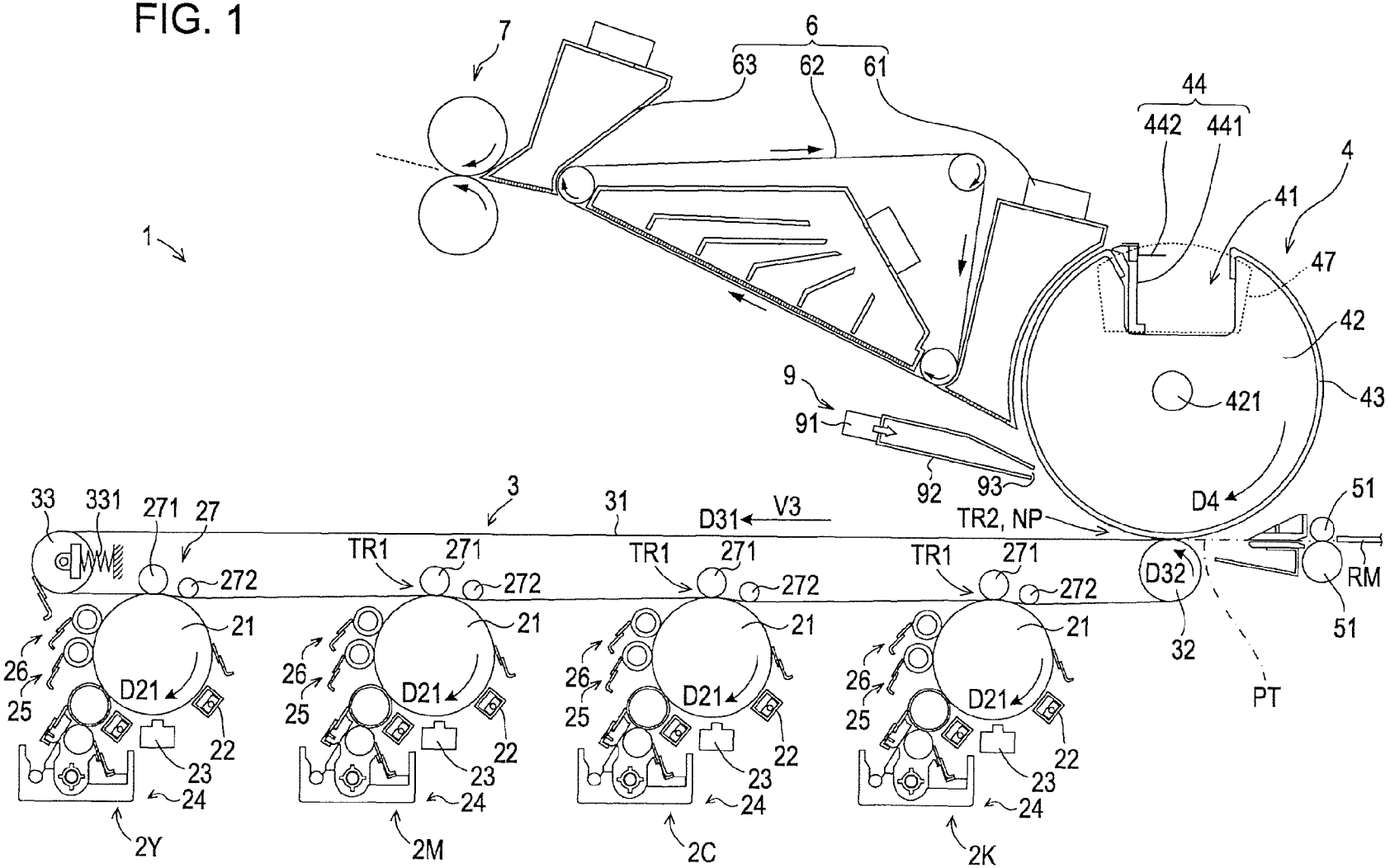
FIG. 1 is a diagram illustrating an embodiment of an image forming apparatus according to the invention.
Figure 2:
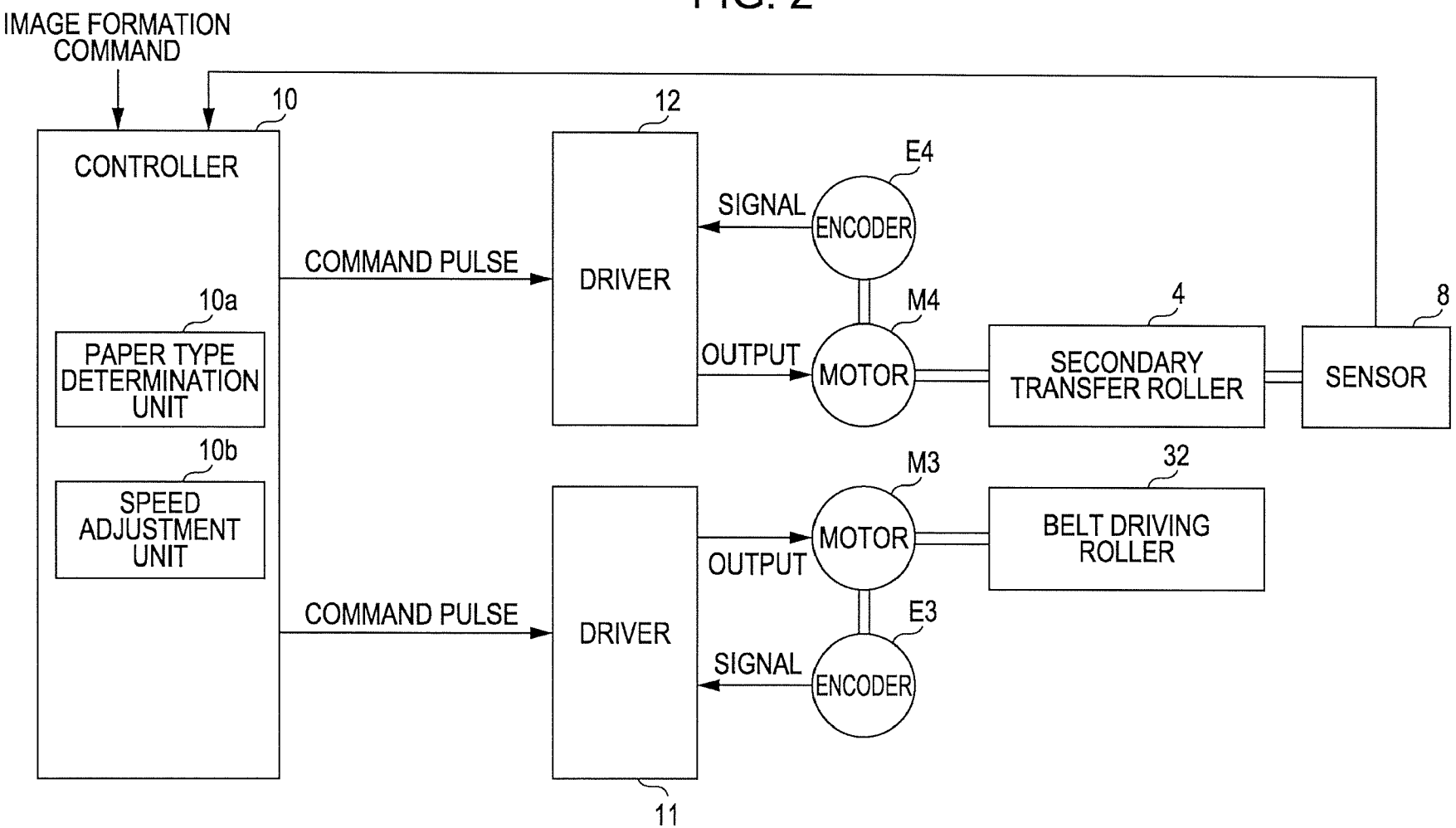
FIG. 2 is a block diagram illustrating the electrical configuration of the apparatus shown in FIG. 1.

FIG. 1 is a diagram illustrating an embodiment of an image forming apparatus according to the invention. FIG. 2, meanwhile, is a block diagram illustrating an electrical configuration of the apparatus illustrated in FIG. 1. This image forming apparatus 1 includes four image forming stations, or 2Y (for yellow), 2M (for magenta), 2C (for cyan), and 2K (for black), that form images of their respective colors, serving as "image creation units" according to the invention. The image forming apparatus 1 is capable of selectively executing a color mode, in which a color image is formed by superimposing yellow (Y), magenta (M), cyan (C), and black (K) toners upon each other, and a monochromatic mode, in which a monochromatic image is formed using only black (K) toner. With this image forming apparatus, when an external device such as a host computer or the like provides a controller 10 including a CPU, a memory, and the like with an image formation command, the controller 10 executes predetermined image formation operations by controlling the various elements of the apparatus, thus forming an image corresponding to the image formation command upon sheet-shaped recording paper RM, such as copy paper, transfer paper, form paper, transparent OHP sheets, or the like.

Each of the image forming stations 2Y, 2M, 2C, and 2K is provided with a photosensitive drum 21, on the surface of which a toner image of the corresponding color is formed. Each photosensitive drum 21 is disposed so that its rotational axis is parallel or approximately parallel to the main scanning direction (the direction perpendicular relative to the paper in FIG. 1), and is rotationally driven at a predetermined speed in the direction of the arrow D21 in FIG. 1.

A charging unit 22, which is a corona charging unit that charges the surface of the photosensitive drum 21 to a predetermined potential, an exposure unit 23 that forms an electrostatic latent image by exposing the surface of the photosensitive drum 21 based on an image signal, a developing unit (developing portion) 24 that visualizes the electrostatic latent image as a toner image, a first squeezing unit 25, a second squeezing unit 26, a primary transfer unit 27 that performs a primary transfer of the toner image onto an intermediate transfer belt 31 of a transfer unit 3, a cleaning unit that cleans the surface of the photosensitive drum 21 following the transfer, and a cleaning blade are disposed in the periphery of each photosensitive drum 21, in that order in the rotational direction D21 of the photosensitive drum 21 (in FIG. 1, the clockwise direction).

The charging unit 22 does not make contact with the surface of the photosensitive drum 21, and a known corona charging unit used in the past can be employed as the charging unit 22. In the case where a scorotron charging unit is employed as the corona charging unit, a positive wire current flows through a charge wire of the scorotron charging unit, and a direct-current (DC) grid-charging bias is applied to the grid. The photosensitive drum 21 is charged by the corona discharge emitted by the charging unit 22, and the potential of the surface of the photosensitive drum 21 is set to an approximately uniform potential.

Each exposure unit 23 exposes the surface of its corresponding photosensitive drum 21 using a light beam based on an image signal received from the external device, thus forming an electrostatic latent image corresponding to the image signal. The exposure units 23 can employ a configuration in which a light beam from a semiconductor laser is caused to scan using a polygon mirror, or can be configured of line heads in which light-emitting elements are arranged in the main scanning direction.

The developing units 24 then apply toner to the respective electrostatic latent images formed in this manner, and the electrostatic latent images are developed by the toner as a result. Note that with the developing units 24 of the image forming apparatus 1, the toner development is carried out using a liquid developer in which toner is dispersed within a carrier liquid at a weight ratio of approximately 20%. In this embodiment, a high-viscosity (approximately 30 to 10000 mPa·s) liquid developer having a toner solid content concentration of approximately 20%, and in which solid particles of a colorant such as a pigment having an average particle diameter of 1 μm are dispersed within a high-concentration and high-viscosity resin that is non-volatile at normal temperatures and added to a liquid carrier such as an organic carrier, silicone oil, mineral oil, or cooking oil along with a dispersant, is used, rather than a volatile liquid developer that uses Isopar (a trademark of Exxon) as its carrier liquid, which is volatile at normal temperatures, has a low concentration (approximately 1-2 wt %), and that has a low viscosity, as has generally been used in the past.

The first squeezing unit 25 is disposed downstream from a developing position in the rotational direction D21 of the photosensitive drum 21, and the second squeezing unit 26 is furthermore disposed downstream from the first squeezing unit 25. Squeeze rollers are provided in the respective squeezing units 25 and 26. The squeeze rollers make contact with the surface of the photosensitive drum 21 and remove residual carrier liquid and fog toner from the toner image. Although residual carrier liquid, fog toner, and so on are removed by the two squeezing units 25 and 26 in this embodiment, it should be noted that the number and arrangement of squeezing units is not intended to be limited thereto; for example, a single squeezing unit may be provided.

The toner image that has passed through the squeezing units 25 and 26 undergoes a primary transfer onto the intermediate transfer belt 31 by the primary transfer unit 27. The intermediate transfer belt 31 is an endless belt serving as an image bearing belt capable of temporarily bearing a toner image on its surface, or to be more specific, on its outer circumferential surface, and is stretched upon multiple rollers 32 and 33. Of these, the roller 32 is mechanically connected to a belt driving motor M3, which functions as a belt driving roller that cyclically drives the intermediate transfer belt 31 in the arrow direction D31 shown in FIG. 1. As shown in FIG. 2, in this embodiment, a driver 11 is provided for driving the belt driving motor M3, and the driver 11 outputs, to the belt driving motor M3, a driving signal based on a command pulse supplied from the controller 10. Through this, the belt driving roller 32 rotates at a rotational frequency that corresponds to the command pulse, and the surface of the intermediate transfer belt 31 moves cyclically in the direction D31 at a constant speed V3. Note that the reference numeral E3 in FIG. 2 indicates an encoder that is attached to the belt driving motor M3; the encoder E3 supplies a signal corresponding to the rotation of the belt driving motor M3 to the driver 11, and the driver 11 performs feedback-based control of the belt driving motor M3 based on the received signal. Accordingly, in this embodiment, the belt driving motor M3 functions as a "first driving source" of the invention.

Although details will be given later, of the rollers 32 and 33 upon which the intermediate transfer belt 31 is stretched, only the aforementioned belt driving roller 32 is driven by the motor, and the other roller 33 is a slave roller that does not have a driving source. This slave roller 33 is a tension roller whose rotational shaft is elastically supported by a spring 331 so as to adjust the tension of the intermediate transfer belt 31. To be more specific, the rotational shaft of the tension roller 33 is elastically supported by the spring 331 so as to freely extend/contract in an approximately horizontal direction, and as a result, the tension roller 33 can freely move by a predetermined amount in an approximately horizontal direction in a state in which the intermediate transfer belt 31 is wound thereupon. Note that the number of rollers upon which the intermediate transfer belt 31 is stretched is not limited to two; the intermediate transfer belt 31 may be stretched upon three or more rollers, and as described above, in such a case, the rollers aside from the driving roller 32 are slave rollers.

The primary transfer unit 27 includes a backup roller 271 and a winding roller 272. The backup roller 271 is disposed so as to oppose the photosensitive drum 21 with the intermediate transfer belt 31 therebetween at a primary transfer location TR1, and makes contact with the photosensitive drum 21 through the intermediate transfer belt 31. Meanwhile, the winding roller 272 is provided downstream in the belt movement direction D31 from that position of contact and pushes the intermediate transfer belt 31 toward the photosensitive drum 21, thus forming a winding portion downstream from the backup roller 271. Furthermore, a primary transfer bias application unit (not shown) is electrically connected to the backup roller 271, and applies a predetermined primary transfer bias, thus transferring the toner image present on the photosensitive drum 21 onto the intermediate transfer belt 31. When the toner images are transferred at the primary transfer units 27 for each of the colors, the toner images of each of the colors upon the photosensitive drums 21 are sequentially superimposed upon the intermediate transfer belt 31, thus forming a full-color toner image. Accordingly, in this embodiment, the intermediate transfer belt 31 configured as described thus far corresponds to the "image bearing member" according to the invention.

The toner images transferred onto the intermediate transfer belt 31 in this manner are then transported to a secondary transfer location TR2, as shown in FIG. 1. A secondary transfer roller 4, which is an example of a "transfer roller" according to the invention, is provided at the secondary transfer location TR2. This secondary transfer roller 4 is disposed so as to oppose the driving roller 32 of the transfer unit 3 upon which the intermediate transfer belt 31 is wound, with the intermediate transfer belt 31 sandwiched therebetween. At the secondary transfer location TR2, the single-color or multi-color toner image formed upon the intermediate transfer belt 31 is transferred onto the recording paper RM that is transported along a transport path PT from a pair of gate rollers 51 and 51. Note that in this embodiment, the toner images are formed using a wet-type developing technique that forms the toner images using a liquid developer, and thus the secondary transfer roller 4, which has a gripping portion that will be described in detail later, is used.

The recording paper RM, onto which the toner image has undergone the secondary transfer, is fed into a transport mechanism 6 from the secondary transfer roller 4 along the transport path PT. A first suction unit 61, a transfer material transport unit 62, and a second suction unit 63 are arranged in that order in the transport mechanism 6 along the transport path PT, and these units function in cooperation with each other to transport the recording paper RM to a fixing unit 7.

Meanwhile, when the recording paper RM, onto which the toner image has undergone the secondary transfer, is fed into the aforementioned transport mechanism 6, a blowing unit 9 is, in this embodiment, disposed opposite to the secondary transfer roller 4 and between the secondary transfer location TR2 and the first suction unit 61 in order to feed the recording paper RM to the first suction unit 61 with certainty and prevent the image thereon from being soiled. With this blowing unit 9, airflow generated through the operation of an airflow generation unit 91 is expelled from an opening portion 93 of a housing portion 92 as indicated by the white arrow; as a result, the air is blown against the leading edge of the recording paper RM, which has been released from the grip of the secondary transfer roller 4 (a gripping portion 44, described later), and that leading edge is pushed in a direction away from the secondary transfer roller 4 by a protruding claw (not shown). In this manner, the leading edge of the recording paper RM is fed toward the first suction unit 61. In addition, the blowing of air onto the recording paper RM makes it possible to prevent the following edge of the recording paper RM from making contact with the intermediate transfer belt 31 or the like so as to suppress the image thereon from being soiled when the following edge is discharged from the secondary transfer location TR2. Note that the air blowing performed by the blowing unit 9 may be omitted in the case where the recording paper RM has a low elastic restitution force and is flimsy.

Furthermore, the fixing unit 7 is disposed downstream in the transport path PT, or in other words, is disposed on the side of the transport mechanism 6 that is opposite to the secondary transfer roller 4 (that is, the left-hand side in FIG. 1), and the single-color or multi-color toner image that has been transferred onto the recording paper RM is fixed onto the recording paper RM by applying heat, pressure, or the like to that toner image.

Figure 3:
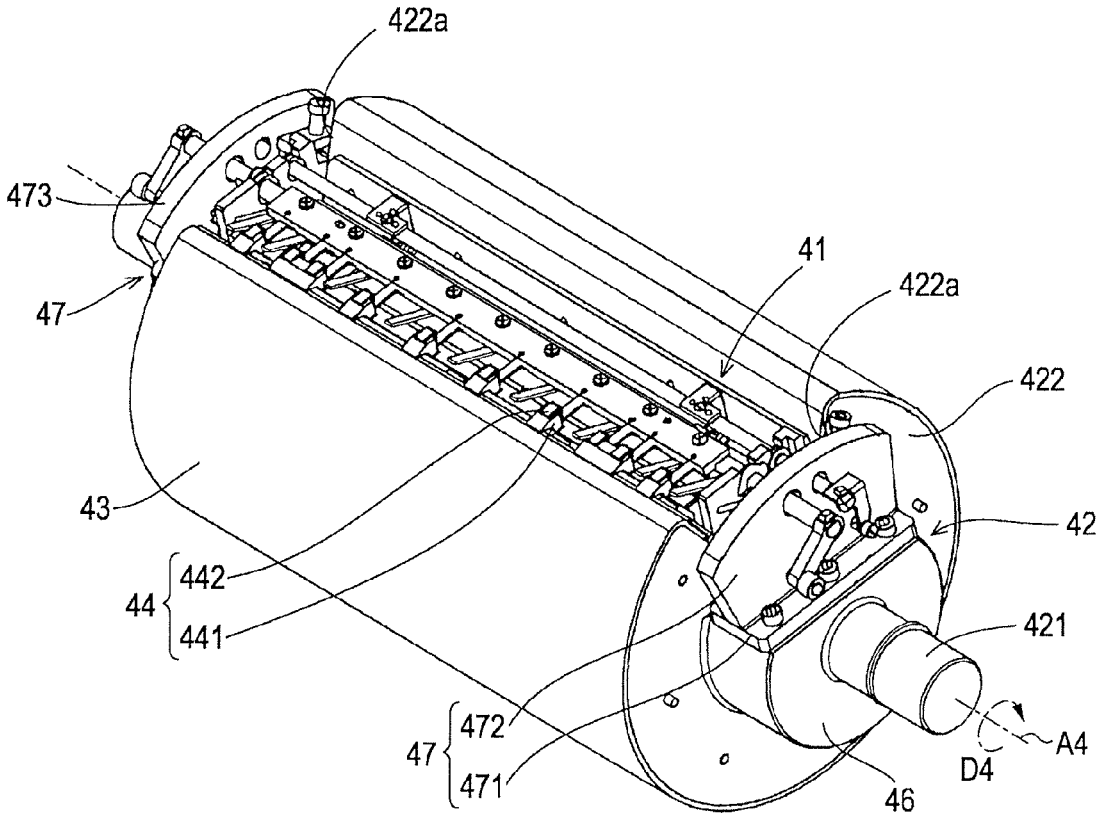
FIG. 3 is a perspective view illustrating the overall configuration of a secondary transfer roller.

FIG. 3 is a perspective view illustrating the overall configuration of the secondary transfer roller. As shown in FIGS. 1 and 3, the secondary transfer roller 4 has a roller base member 42 in which a concaved portion 41, formed by cutting out part of the outer circumferential surface of the roller cylinder, is provided. With this roller base member 42, a rotational shaft 421 that freely rotates in a direction D4 central to a rotational axis A4 is disposed so as to be parallel or approximately parallel to the rotational axis of the driving roller 32, and the roller base member 42 is biased toward the driving roller 32 by a pressure unit (not shown) and is thus given a predetermined load (in this embodiment, 60 kgf, as shown in FIG. 7). Meanwhile, side plates 422 and 422 are respectively attached to the ends of the rotational shaft 421. To be more specific, the side plates 422 and 422 each have a shape in which a cutout portion 422*a* is provided in a disk-shaped metallic plate. As shown in FIG. 3, the cutout portions 422*a* and 422*a* are provided on the rotational shaft 421 at a distance that is slightly longer than the width of the intermediate transfer belt 31, and are provided opposite to each other. Accordingly, the roller base member 42 is formed so as to have an overall drum shape, but to also have the concaved portion 41 extending parallel or approximately parallel to the rotational shaft 421 in a portion of its outer circumferential surface.

Meanwhile, an elastic layer 43, configured of rubber, a resin, or the like, is formed upon the outer circumferential surface of the roller base member 42, or in other words, on the surface region of the metallic plate excluding the region corresponding to the inner area of the concaved portion 41. The elastic layer 43 opposes the intermediate transfer belt 31 that is wound upon the driving roller 32, thus forming a transfer nip NP.

In addition, a gripping portion 44 for gripping the recording paper RM is disposed within the concaved portion 41. This gripping portion 44 includes gripper support members 441 erected from the inner base area of the concaved portion 41 toward the outer circumferential surface of the roller base member 42 and gripper members 442 supported so as to be freely making contact with/separating from the tip areas of corresponding gripper support members 441. Each of the gripper members 442 is connected to a gripper driving unit (not shown). Upon receiving a release command from the controller 10, the gripper driving unit operates so that the tip areas of the gripper members 442 separate from the tip areas of the gripper support members 441, thus preparing to grip the recording paper RM, releasing a caught recording paper RM, and so on. On the other hand, upon receiving a grip command from the controller 10, the gripper driving unit operates so that the tip areas of the gripper members 442 move to the tip areas of the gripper support members 441, thus gripping the recording paper RM. Note that the configuration of the gripping portion 44 is not intended to be limited to this embodiment, and, for example, a known past gripping mechanism such as that disclosed in JP-T-2000-508280 may be employed as well.

A support member 46 is attached to the outside surface of each of the side plates 422 at both ends of the secondary transfer roller 4, and each is capable of rotating integrally with the roller base member 42. Furthermore, planar regions 461 are formed on the support members 46 in correspondence with the concaved portion 41. Transfer roller-side contact members 47 are attached to the respective planar regions 461. In each contact member 47, a base section 471 is attached to the support member 46, and a contact section 472 extends from the base section 471 in the normal line direction of the planar region 461; the tip area of the contact section 472 extends to the vicinity of the side end of the opening of the concaved portion 41. In other words, if the roller base member 42 is viewed from the end of the rotational shaft 421, the contact members 47 are disposed so as to cover the concaved portion 41. Accordingly, when the concaved portion 41 has reached a position opposite to the intermediate transfer belt 31 due to the rotation of the secondary transfer roller 4, the contact member 47 makes contact with the end surface of the driving roller 32. Through this, the fluctuations in the load torque of the motor that rotationally drives the secondary transfer roller 4 can be reduced.

Note that in this embodiment, the length of the opening (opening width) W41 of the concaved portion 41 along the rotational direction D4 of the roller base member 42 is approximately 105 mm. When the elastic layer 43 formed upon the regions of the outer circumferential surface of the secondary transfer roller 4 aside from the concaved portion 41 is opposite to the intermediate transfer belt 31, the elastic layer 43 is pressed against the intermediate transfer belt 31, thus forming the transfer nip NP. The length of the transfer nip NP in the rotational direction D4 of the roller base member 42 (the transfer nip width) Wnp is approximately 11 mm, and thus the following relationship is established:

(opening width *W*41 of concaved portion 41)>(transfer nip width *Wnp* of transfer nip *NP*)

Accordingly, the transfer nip temporarily disappears when the concaved portion 41 of the secondary transfer roller 4 opposes the intermediate transfer belt 31.

Meanwhile, the length of the elastic layer 43 along the rotational direction D4 of the roller base member 42 is set to approximately 495 mm, which is in order to enable the largest size recording paper RM that can be used in the apparatus 1 to be wound thereupon. In other words, the length of the elastic layer 43 is set to be longer than the length of the usable recording paper whose length along the rotational direction D4 of the roller base member 42 is the maximum length.

A transfer roller driving motor M4 is mechanically connected to the rotational shaft 421 of the secondary transfer roller 4. In this embodiment, a driver 12 for driving the transfer roller driving motor M4 is also provided, as shown in FIG. 2. The driver 12 drives the motor M4 based on commands supplied by the controller 10, thus rotationally driving the secondary transfer roller 4 in the direction D4, which is the clockwise direction in FIG. 1, or in other words, in the same direction relative to the belt movement direction D31. Accordingly, in this embodiment, the transfer roller driving motor M4 functions as a "second driving source" of the invention.

In this embodiment, the driver 12 outputs, to the motor M4, a driving signal that is based on a command pulse supplied by the controller 10. Through this, the transfer roller rotates at a rotational frequency corresponding to the command pulse.

Note that the reference numeral E4 in FIG. 2 indicates an encoder attached to the transfer roller driving motor M4; the encoder E4 supplies a signal corresponding to the rotation of the transfer roller driving motor M4 to the driver 12, and the driver 12 performs feedback-based control of the motor M4 based on the received signal. Meanwhile, the reference numeral 8 indicates a phase detection sensor linked to one end of the rotational shaft 421 of the secondary transfer roller 4, and the controller 10 is capable of grasping the timing at which the recording paper RM passes through the transfer nip NP based on the output of this phase detection sensor 8. Note that the sensor configuration will be described with reference to FIG. 4.

In addition, while the controller 10 executes the image formation operations in accordance with the image formation command from the external device, the image formation command contains information related to the paper type of the recording paper RM. In other words, a printer driver of the image forming apparatus 1 is installed in the external device connected to the image forming apparatus 1, and a user selects the type of the recording paper RM to be used in printing, or in other words, the paper type, through a print setting screen of the printer driver. Information regarding the selected paper type is then supplied to the controller 10 along with other print information as the image formation command. The controller 10 includes a paper type determination unit 10*a* that determines the paper type of the recording paper RM based on the paper type information contained in the image formation command and a speed adjustment unit 10*b* that adjusts the rotational frequency of the secondary transfer roller, and forms images while adjusting the rotational frequency of the secondary transfer roller 4 based on the paper type of the recording paper RM, as will be described hereinafter. Accordingly, in this embodiment, the speed adjustment unit 10*b* in the controller 10 corresponds to a "control unit" according to the invention.

Next, operations performed by the image forming apparatus 1 configured as described thus far will be described with reference to FIGS. 4A through 7. FIGS. 4A through 4D, 5A, and 5B are diagrams schematically illustrating operations performed by the image forming apparatus illustrated in FIG. 1. FIG. 6, meanwhile, is a timing chart illustrating a relationship between the output of the phase detection sensor and the rotational frequency of the secondary transfer roller. Furthermore, FIG. 7 is a diagram illustrating a relationship between the paper type of the recording paper and the rotational frequency of the secondary transfer roller. Note that the "basis weight" and "paper thickness" in FIG. 7 are values regarding the recording paper RM; in this embodiment, the rotational frequency of the secondary transfer roller 4 with respect to three paper types is specified separately for when the recording paper RM is passing through the transfer nip NP (when the recording paper RM is pinched by the transfer nip NP) and other times (when the concaved portion 41 is opposite the intermediate transfer belt 31 and when the circumferential surface is in direct contact with the intermediate transfer belt 31), and these specifications are stored, in advance, in a memory (not shown) of the controller 10 in table format. Furthermore, the "secondary transfer load" in FIG. 7 indicates the load applied to the intermediate transfer belt 31 at the secondary transfer location TR2 as the secondary transfer roller 4 is biased toward the driving roller 32, and is, in this embodiment, fixed at a constant 60 kgf, even if the paper type of the recording paper RM changes.

With the image forming apparatus 1, when an image formation command prompting the formation of a color image has been supplied by the external device such as a host computer or the like to the controller 10, the controller 10 controls the various elements of the apparatus in accordance with programs stored in a memory (not shown). First, the belt driving motor M3 and the transfer roller driving motor M4 operate, thus driving the intermediate transfer belt 31 and the secondary transfer roller 4, respectively.

Then, the phase detection sensor 8 (FIG. 2) provided in the secondary transfer roller 4 temporarily outputs an H level signal when the surface of the secondary transfer roller 4 opposing the intermediate transfer belt 31 at the secondary transfer location TR2 changes from the cylindrical circumferential surface on which the elastic layer 43 is provided to the concaved portion 41, and when the concaved portion 41 changes to the elastic layer 43. In other words, with the phase detection sensor 8, a disk-shaped slit plate 81 is connected to the rotational shaft 421 of the secondary transfer roller 4 and rotates along with the rotational shaft 421, as shown in FIGS. 4A through 4D and 5A through 5B. Slits 811 and 812 are formed in two locations in the slit plate 81. Whereas the slit 811 is used for detecting a nip ending position, or in other words, the position at which the elastic layer 43 separates from the intermediate transfer belt 31, the slit 812 is used for detecting a nip starting position, or in other words, the position at which the elastic layer 43 begins to make contact with the intermediate transfer belt 31, thus forming the transfer nip NP. Furthermore, with the phase detection sensor 8, a sensor element 82 for detecting the slits 811 and 812 is disposed in a fixed manner; each time the slits 811 and 812 are within the detection range of the sensor element 82, the level of a signal outputted from the sensor element 82 to the controller 10 changes from L level to H level, thus making it possible to detect the nip ending position and the nip starting position, respectively. Accordingly, the recording paper RM is detected as passing into the transfer nip NP when the slit 812 is positioned within the detection range of the sensor element 82.

As shown in FIGS. 6 and 7, when the concaved portion 41 of the secondary transfer roller 4 is opposite to the intermediate transfer belt 31, the secondary transfer roller 4 is caused to rotate at a predetermined rotational frequency V1 (in this embodiment, 24.63 rpm, as indicated in FIG. 7). On the other hand, when the elastic layer 43 is opposite to the intermediate transfer belt 31 and the transfer nip NP is formed as a result, the secondary transfer roller 4 is adjusted to a rotational frequency V2 in accordance with the paper type of the recording paper RM, only for the period during which the recording paper RM is passing through the transfer nip NP, as will be described later. Note that the belt driving motor M3 always cyclically moves the surface of the intermediate transfer belt 31 at a predetermined speed of movement V3.

When the output of the phase detection sensor 8 changes at a predetermined timing, and the secondary transfer roller 4 changes from the concaved portion 41 to the elastic layer 43 at the secondary transfer location TR2 and the transfer nip NP is formed, that timing is used as an exposure starting point; toner images are formed at the image forming stations 2Y, 2M, 2C, and 2K, and the toner images then undergo a primary transfer onto the surface of the intermediate transfer belt 31. In other words, when a predetermined amount of time has elapsed following the aforementioned timing, the exposure unit 23 commences latent image formation in the image forming station 2Y based on various signals from the controller 10, thus forming a toner image from yellow toner. An exposure for magenta is commenced after the exposure for yellow has been commenced, an exposure for cyan is commenced after the exposure for magenta has been commenced, and an exposure for black is commenced after the exposure for cyan has been commenced. Accordingly, toner images of each of the colors are formed and superimposed in order upon the intermediate transfer belt 31, thus forming a full-color toner image TI upon the surface of the intermediate transfer belt 31.

Figure 4A:
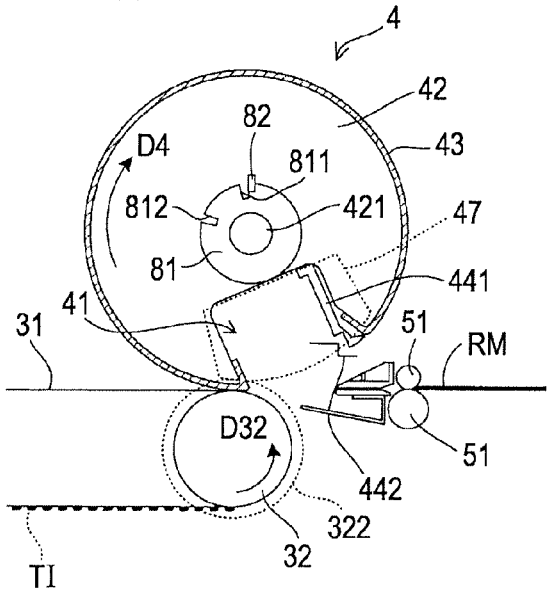
FIGS. 4A through 4D are diagrams schematically illustrating operations performed by the image forming apparatus illustrated in FIG. 1.

While the toner images of each of the colors are being formed in this manner, the secondary transfer roller 4 rotates further in the rotational direction D4, and the transfer nip NP that has disappeared is formed once again. When a predetermined amount of time has elapsed following this timing, the controller 10 inputs a command pulse to a driver (not shown) that controls a gate roller driving motor (also not shown) connected to the gate rollers 51, thus causing the gate roller driving motor to operate. As a result, transport of the recording paper RM to the secondary transfer location TR2 commences (FIG. 4A). In addition, the paper type of the recording paper RM is determined by the paper type determination unit 10*a* of the controller 10 based on the paper type information contained in the image formation command, and the optimum value for the rotational frequency V2 of the secondary transfer roller 4 for the transfer onto the recording paper RM is read out from the table in FIG. 7. Note that the timing of this readout is not limited to when the transport of the recording paper RM is commenced, and the readout may be performed any time prior to the recording paper RM reaching the transfer nip NP.

Figure 4B:
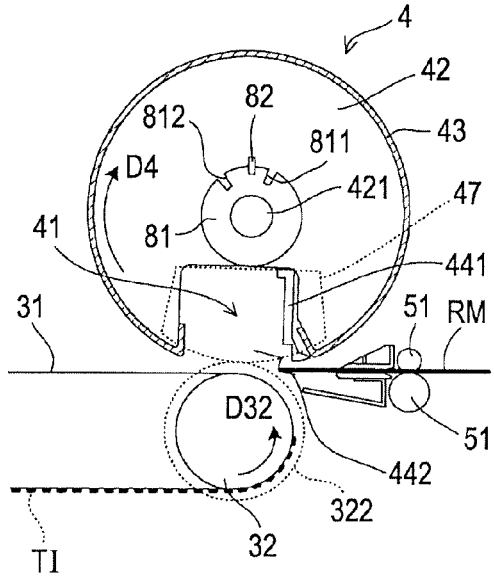

Meanwhile, when the secondary transfer roller 4 changes to the concaved portion 41 at the secondary transfer location TR2 and the transfer nip disappears, the slit 811 is positioned within the detection range of the sensor element 82, and thus the level of the signal outputted by the sensor element 82 to the controller 10 changes from the L level to the H level. Based on this signal, the controller 10 supplies a command pulse to the driver 12. As a result, the secondary transfer roller 4 rotates in the rotational direction D4, moving to a predetermined recording paper gripping position (FIG. 4B). Meanwhile, the tip areas of the gripper members 442 are caused to separate from the tip areas of the gripper support members 441, thus completing preparations for gripping the recording paper RM. The leading edge of the recording paper RM fed from the gate rollers 51 enters between the gripper members 442 and the gripper support members 441, thus commencing a paper gripping operation.

Figure 4C:
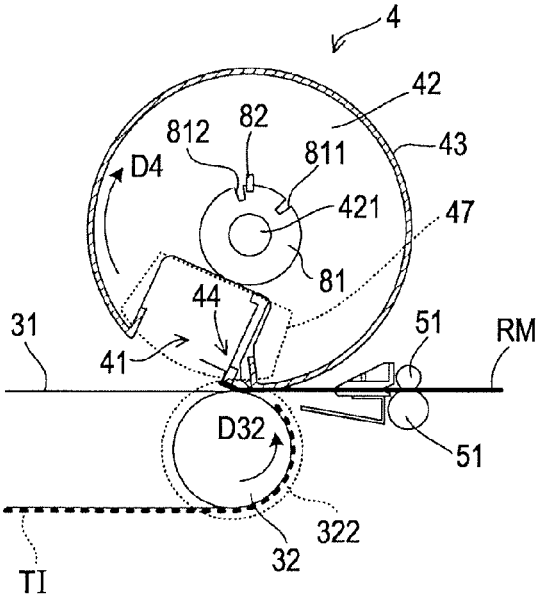

The controller 10 then supplies a grip command to the gripper driving unit (not shown). The gripper driving unit operates based on this grip command, causing the tip areas of the gripper members 442 to move to the tip areas of the gripper support members 441. As a result, the leading edge of the recording paper RM is caught, thus completing the paper gripping operation (FIG. 4C). Note that at the point in time when the paper gripping operation is completed, the toner image TI is located upstream from the secondary transfer location TR2 in the movement direction D31 of the surface of the intermediate transfer belt 31, as shown in FIG. 4C.

Figure 4D:
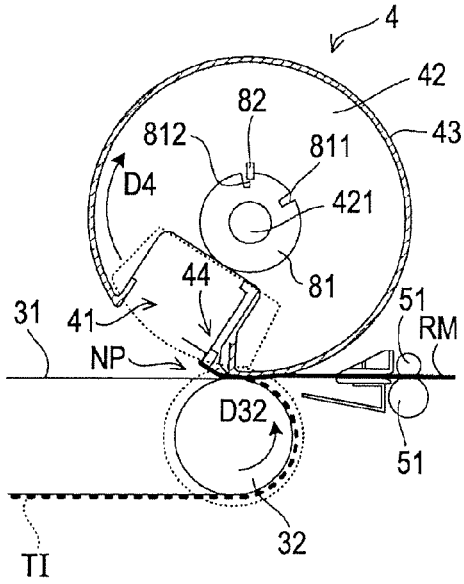

In this manner, the recording paper RM is transported in the rotational direction D4 along with the secondary transfer roller 4 with its leading edge caught by the gripping portion 44. Then, at the timing at which the elastic layer 43 on the surface of the secondary transfer roller 4 reaches the secondary transfer location TR2 and the formation of the transfer nip NP starts, the slit 812 is located within the detection range of the sensor element 82, as shown in FIGS. 4D and 6; thus the level of the signal outputted to the controller 10 by the sensor element 82 (the "sensor output" in FIG. 6) changes from the L level to the H level. Based on this signal, the controller 10 changes the rotational frequency of the secondary transfer roller 4 from the rotational frequency V1 to the rotational frequency V2. In this embodiment, the rotational frequency V2 is switched in accordance with the paper type of the recording paper RM, and in particular in accordance with the paper thickness. To be more specific, the rotational frequency V2 is set to 24.51 rpm, 24.50 rpm, and 24.48 rpm for recording paper RM having paper thicknesses of 0.15 mm, 0.25 mm, and 0.30 mm, respectively.

The secondary transfer roller 4 rotates at the number of rotations V2 set in this manner, resulting in the recording paper RM being pinched in the transfer nip NP formed by the secondary transfer roller 4 and the intermediate transfer belt 31 and being transported through the rotation of the secondary transfer roller 4. As a result, the secondary transfer of the toner image TI formed on the intermediate transfer belt 31 onto the lower surface (the image surface) of the recording paper RM is commenced (FIG. 4D). Meanwhile, at this timing, the controller 10 switches the driving control system of the driver 12 to torque-control using a control switching signal, and performs torque-controlling of the secondary transfer roller 4 by supplying a specified torque command to the driver 12.

Figure 5A:
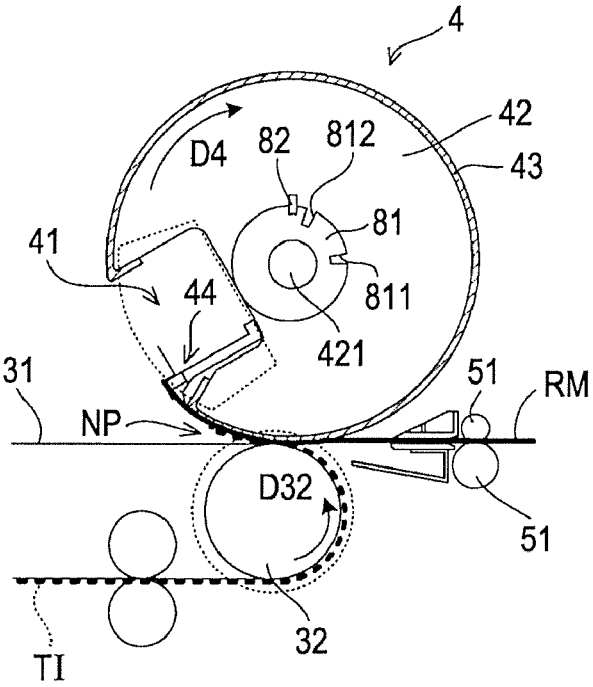
FIGS. 5A and 5B are diagrams schematically illustrating operations performed by the image forming apparatus illustrated in FIG. 1.
Figure 5B:
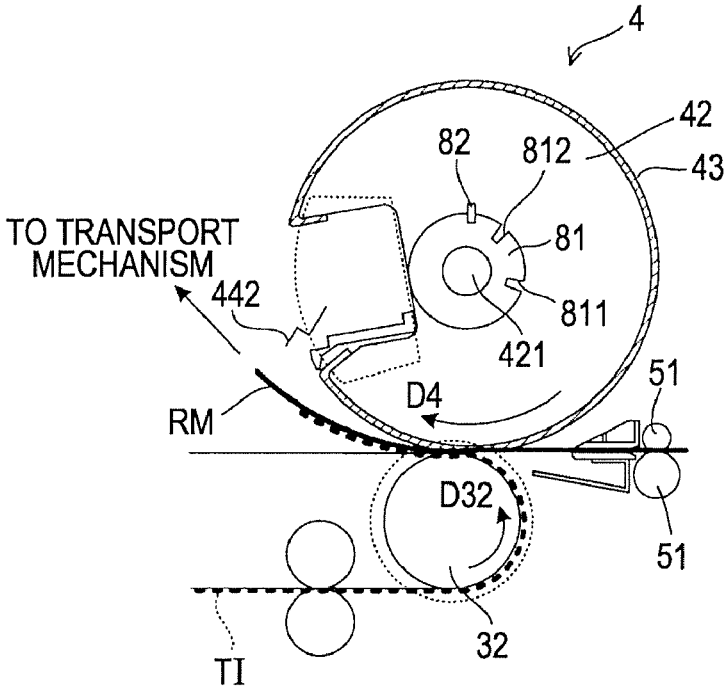
Figure 6:
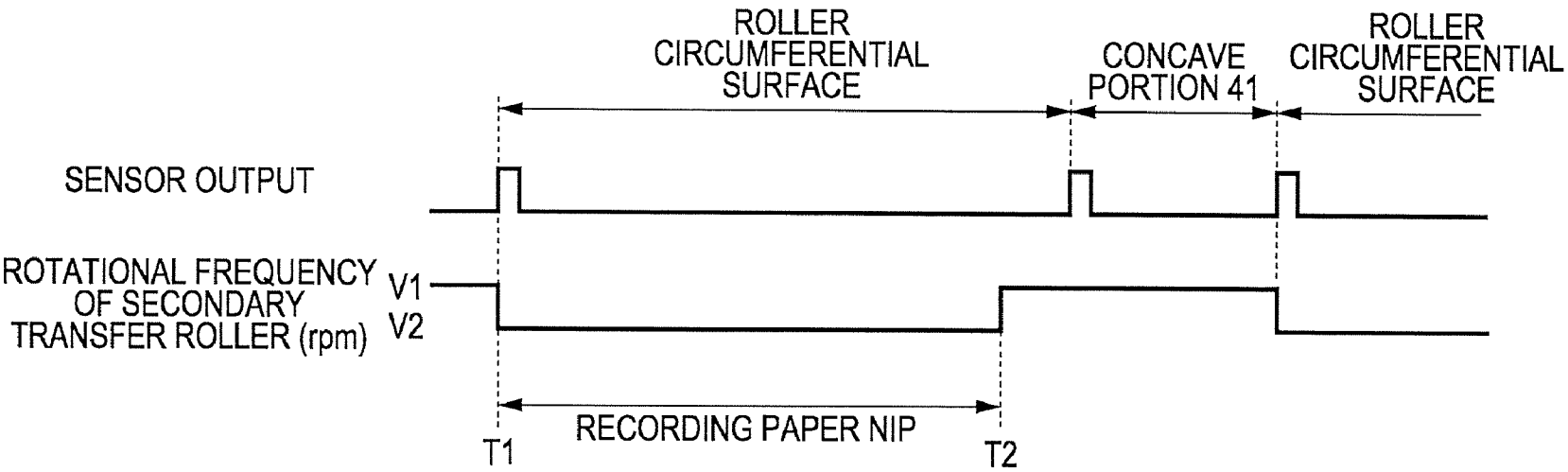
FIG. 6 is a timing chart illustrating a relationship between a sensor output and a roller rotational frequency.

The secondary transfer roller 4 rotates in the rotational direction D4 while undergoing torque control in this manner; as a result, the recording paper RM passes through the transfer nip NP with its leading edge held by the gripping portion 44, and the secondary transfer of the toner image TI progresses further (FIG. 5A). Then, when the gripping portion 44 moves to a position in the vicinity of the transport mechanism 6, the leading edge of the recording paper that is held by the gripping portion 44 separates from the intermediate transfer belt 31 to a sufficient degree, and is transported to a transport entrance of the transport mechanism 6. As shown in FIG. 5B, the controller 10 supplies a release command to the gripper driving unit when the gripping portion 44 has moved to the vicinity of the upstream end of the transport mechanism 6, causing the tip areas of the gripper members 442 to separate from the tip areas of the gripper support members 441, thus releasing the recording paper RM. Through this, the leading edge of the recording paper RM is fed to the transport mechanism 6 with certainty, without sticking to the surface of the intermediate transfer belt 31. The color toner image TI is then fixed to the recording paper RM by the fixing unit 7, which is disposed after the transport mechanism 6. Note that following the release, the leading side of the recording paper RM is transported toward the fixing unit along the transport path PT, whereas the following side of the recording paper RM undergoes the secondary transfer process while being pinched and transported at the transfer nip NP by the elastic layer 43 of the secondary transfer roller 4 and the intermediate transfer belt 31. When the following side of the recording paper RM passes through the transfer nip NP, the rotational frequency of the secondary transfer roller 4 is changed back to the rotational frequency V1 from the rotational frequency V2, as shown in FIG. 6.

As described thus far, according to this embodiment, the rotational frequency of the secondary transfer roller 4 is adjusted based on the paper type of the recording paper RM when the recording paper RM is nipped at the transfer nip NP. Because the recording paper RM follows the rotational frequency of the secondary transfer roller 4 when the recording paper RM passes through the transfer nip NP, control of the speed of movement of the recording paper RM based on the rotational frequency of the secondary transfer roller 4 is employed, and thus controlling the rotational frequency of the secondary transfer roller 4 as described above makes it possible to control differences between the speed of movement of the recording paper RM and the speed of movement of the intermediate transfer belt 31. Suppressing such differences in speeds makes it possible not only to suppress abrasions from occurring in images at the transfer nip NP but also to suppress fluctuations in the speed of the intermediate transfer belt 31, which in turn makes it possible to form a favorable image on the recording paper RM.

Meanwhile, the thickness of the recording paper RM affects the speed of movement at the transfer nip NP. In other words, heavy paper has a higher speed of movement at the transfer nip NP than light paper. Accordingly, in the aforementioned embodiment, the rotational frequency V2 of the secondary transfer roller 4 is reduced as the recording paper RM increases in thickness, as shown in FIG. 7. As a result, the speed of movement of the recording paper RM when passing through the transfer nip NP is almost the same as the speed of movement of the intermediate transfer belt 31 regardless of which of the recording papers RM of the different paper thicknesses an image is being transferred onto, and thus the aforementioned effects can be achieved.

In addition, in this embodiment, the motor M3 is controlled so that the speed of movement V3 of the intermediate transfer belt 31 is constant, and thus a problem in which the toner image that undergoes primary transfer onto the intermediate transfer belt 31 expands/contracts in the movement direction D31, a problem in which the toner images of the various colors experience relative positional skew (registration skew), and so on can be prevented, thus making it possible to increase the image quality.

Note that the invention is not limited to the aforementioned embodiment, and various modifications are possible in addition to the content described above without departing from the spirit of the invention. For example, in the aforementioned embodiment, the image forming apparatus 1 is configured so as to be compliant with three paper types, as shown in FIG. 7; however, the paper types are not limited thereto, and the configuration may be such that the rotational frequency of the secondary transfer roller 4 is adjusted to be compliant with each of multiple paper types.

In addition, in the aforementioned embodiment, the paper type determination unit 10*a* of the controller 10 determines the paper type of the recording paper RM based on the paper type information contained in the image formation command, but the configuration may be such that a user inputs the paper type information via an operation panel (not shown) provided in the image forming apparatus 1 and the paper type determination unit 10*a* determines the paper type based on that inputted information. In addition, the configuration may be such that a paper type detection sensor is provided in a cassette that holds the recording paper RM, and the paper type determination unit 10*a* determines the paper type based on a signal outputted by that sensor.

The entire disclosure of Japanese Patent Application No: 2009-205826, filed Sep. 7, 2009 is expressly incorporated by reference herein.

What is claimed is:

1. An image forming apparatus comprising:

an image bearing belt that bears an image;

an image creation unit that transfers the image on the image bearing belt;

a first driving source;

a driving roller, on which the image bearing belt is wound, that is rotationally driven by the first driving source and causes the image bearing belt to move;

a transfer roller that has a concaved portion formed by cutting out part in a circumferential surface, forms a transfer nip by the circumferential surface of the transfer roller making contact with the image bearing belt, and transfers the image on the image bearing belt to a recording material that passes through the transfer nip;

a second driving source that rotationally drives the transfer roller;

a recording material type determination unit that determines the type of the recording material that passes through the transfer nip; and a control unit that controls a rotational frequency of the transfer roller to be a first rotational frequency when the recording material is not nipped by the transfer nip, and to be an second rotational frequency when the recording material is nipped by the transfer nip, the second rotational frequency being set based on the type of the recording material determined by the recording material type determination unit.

2. The image forming apparatus according to claim 1, wherein the rotation frequency of the transfer roller is adjusted by the control unit controlling the second driving source.

3. The image forming apparatus according to claim 1, wherein the information of the type of the recording material includes information of a thickness of the recording material, the control unit controls the transfer roller to assume a first rotational frequency when the thickness of the recording material is a first thickness, and the control unit controls the transfer roller to assume a second rotational frequency that is lower than the first rotational frequency when the thickness of the recording material is a second thickness that is thicker than the first thickness.

4. The image forming apparatus according to claim 1, wherein the concaved portion in the circumferential surface of the transfer roller includes a gripping member that grips the recording material.

5. An image forming method comprising:

bearing an image on an image bearing belt that is moved by a first driving source;

transporting a recording material to a transfer nip formed by a circumferential surface of a transfer roller, that includes a concaved portion by cutting out part in a circumferential surface, making contact with the image bearing belt while rotationally driving the transfer roller using a second driving source; and adjusting a rotational frequency of the transfer roller to be a first rotational frequency when the recording material is not nipped by the transfer nip, and to be a second rotational frequency when the recording medium is nipped by the transfer roller, the second rotational frequency being set based on the type of the recording material determined by the recording martial type.

* * * * *